US007094152B2

(12) United States Patent
Rush et al.

(10) Patent No.: US 7,094,152 B2
(45) Date of Patent: Aug. 22, 2006

(54) POSITIVE-RETURN GAMBLING

(75) Inventors: Nicholas James Rush, Clayton, CA (US); Jason M. Kapalka, San Francisco, CA (US); Sukhbir Singh Sidhu, Walnut Creek, CA (US)

(73) Assignee: Electronic Arts Inc., Redwood City, CA (US)

( * ) Notice: Subject to any disclaimer, the term of this patent is extended or adjusted under 35 U.S.C. 154(b) by 0 days.

(21) Appl. No.: 11/155,337

(22) Filed: Jun. 16, 2005

(65) Prior Publication Data

US 2006/0035704 A1 Feb. 16, 2006

Related U.S. Application Data

(63) Continuation of application No. 09/715,385, filed on Nov. 16, 2000, now Pat. No. 6,966,836.

(51) Int. Cl.
*A63F 9/24* (2006.01)

(52) U.S. Cl. ..... 463/28; 463/25

(58) Field of Classification Search ..... 463/28, 463/25

See application file for complete search history.

*Primary Examiner*—Corbett B. Coburn
(74) *Attorney, Agent, or Firm*—Townsend and Townsend and Crew LLP; Gerald T. Gray

(57) ABSTRACT

A method and system of providing players with positive return in a gambling game. Tokens are won or lost in a manner that assures net positive return. Token value is determined based on the total number of outstanding tokens, or on the total number that have been issued in a predetermined time period, so that the total prize payout is predetermined and constant. In one embodiment, tokens act as lottery tickets, and prizes are awarded to winners of the lottery, so that a player's chance of winning the lottery is based on the percentage of outstanding tokens he or she possesses.

20 Claims, 2 Drawing Sheets

POSITIVE-RETURN GAMBLING

CROSS-REFERENCES TO RELATED APPLICATIONS

This application is a continuation of U.S. patent application Ser. No. 09/715,385, filed Nov. 16, 2000 now U.S. Pat. No. 6,966,836, the disclosure of which is hereby incorporated by reference in its entirety for all purposes.

BACKGROUND OF THE INVENTION

1. Field of the Invention

The present invention is related to gambling, and more particularly to a gambling model that yields a net positive return for the player.

2. Description of the Background Art

In typical casino-style games the specific game odds and payouts have been calculated to provide the player with a negative return on his or her bets over time. The odds of success in each of these games combined with the rewards for each winning event are set in such a way as to ensure that the player slowly but steadily loses money to the house over time. This formula represents the primary means of casino's income.

Although many casinos and other gambling establishments attract players despite the net negative return, it is evident that players would be even more attracted to a gambling establishment that would provide a positive return. However, with conventional business models for casinos and online gambling sites, it is not feasible to provide a positive return for players. Such a scheme would cause the casino or site operator to lose money; in fact, the more gambling took place, the more the casino or site operator would lose. A player could keep on playing indefinitely and continue to experience a positive return.

What is needed is a gambling model that yields a net positive return for players, thus extending the play period and creating a more positive player experience, while maintaining commercial feasibility. What is further needed is a gambling model that provides a satisfying gambling experience (true sense of risk and reward) while still giving the player a positive return.

SUMMARY OF THE INVENTION

The present invention provides a gambling model that provides players with a consistently positive return on investment over time. The model maintains commercial viability, and does not provide an opportunity for unlimited payout to a player. Repeated and prolonged play results in correspondingly higher winnings, but such winnings are provided in the form of prize tokens whose value diminishes as more prize tokens are issued. Regardless of how many prize tokens are issued in total, the total value of all outstanding prize tokens remains constant. In one embodiment, prize tokens are cashed out regularly, so that the total value of tokens issued in a given time period remains constant, but a new batch of tokens would become available, and have new value, the next time period.

The present invention may be implemented, for example, on a website or online portal that offers a suite of betting and casino-style games. Gameplay and payouts of the games are adjusted, as described below, to provide the player with a consistently positive return on investment over time. This suite of modifications maintains the balance of winning and losing events to ensure that the players still have a sense of risk and reward and enjoyable gameplay while allowing them to experience a consistent sense of gain and success. This change to traditional casino payouts creates high levels of motivation for players to continue playing for long periods of time.

The gambling model of the present invention enables a casino or site operator to maintain these consistently positive payouts through the use of an infinitely extensible virtual currency. Rather than providing wagering with actual cash or other items of value, the model of the present invention establishes durable accounts of prize tokens (referred to herein as "tokens") for its players. These tokens do not have a defined cash value; their value is definable as a function of the total number of such tokens, or the total number that have been issued in a given time period. Thus, regardless of how many tokens a player might win, the total payout to all players is limited to a known value (or a known value per time period). Thus the tokens do not have any fixed intrinsic value and can be "manufactured"at will by the site operator with no economic impact. Players are assigned a starting amount of tokens with which they can gamble; tokens can be won or lost in the same manner as regular currency (or chips).

In one embodiment, tokens cannot be directly exchanged for any item of value, but can be converted into entries in a fixed number of drawings for cash prizes. Because the tokens can be used to enter drawings for items of value, players perceive them to have value, and have an emotional stake in their gain or loss.

For example, a daily drawing for $100 might be conducted. No matter how many tokens are "manufactured" or paid out, the actual value of all winnings is limited to $100. However, the more prize tokens are paid out in total, the smaller the value of each individual token. If 100 prize tokens are paid out, each has a value of $1 (since there is a 1% chance of winning the $100 prize); but if 500 prize tokens are paid out, each has a value of 20 cents (since there is a 0.2% chance of winning the $100). Individual players see a perceived value in the tokens, however, since repeated or prolonged play yields a net positive return in tokens, and can result in the player having a larger share of the total number of tokens in circulation. Thus, repeated or prolonged play results in a net gain for players without increasing the real payout experienced by the site operator or casino.

The daily drawing is merely exemplary of one application of the invention. Other applications are possible. For example, tokens might be assessed a daily value after all payouts for the day are completed. The daily value might be determined as a fraction of the total prize payout for the day, which can be determined in advance. Thus, if $100 is to be paid out daily, then each player would receive a share of the $100 corresponding to his or her share of total prize tokens that were issued that day. If 100 tokens are paid out, each token can be exchanged for $1; if 500 tokens are paid out, each can be exchanged for 20 cents. Conversion and payout may be made mandatory or optional, as appropriate for the particular implementation of the invention.

DETAILED DESCRIPTION OF THE PREFERRED EMBODIMENTS

Architecture

Figure 1:
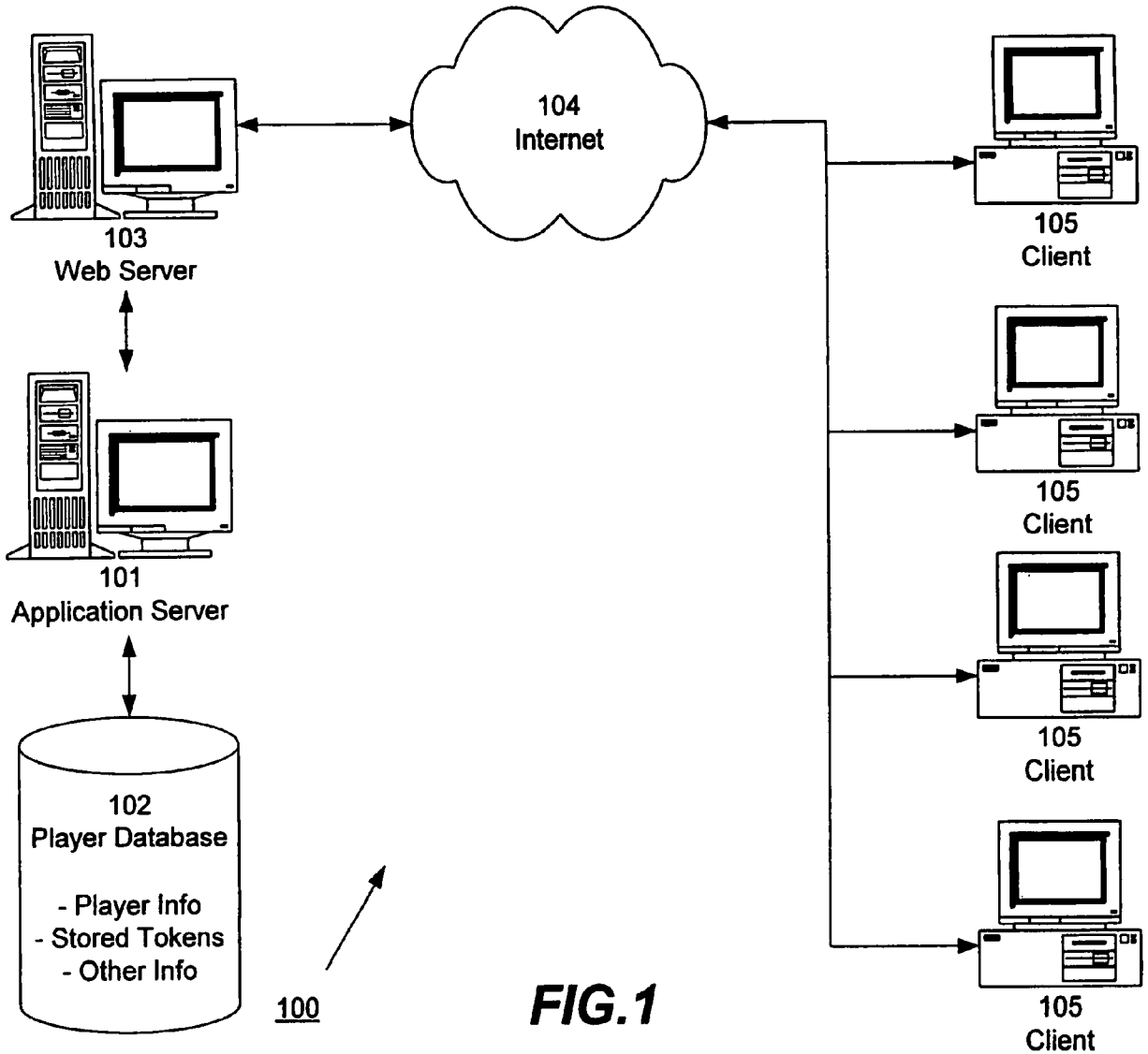
FIG. 1 is a block diagram of an architecture for practicing the present invention.

Referring now to FIG. 1, there is shown a block diagram of an architecture for practicing the present invention. One skilled in the art will recognize that the architecture as depicted is merely an example of an implementation of the invention, and that many other implementations are possible without departing from the essential characteristics of the invention. For example, the positive-return gambling model of the present invention can be used in conventional casinos, including machine-based games (e.g. slot machines, video poker), or human-operated games (e.g. roulette, craps, blackjack).

System 100 is presented as an Internet-based application for implementing a gambling website. In such an embodiment, the invention is implemented in the context of an Internet website that provides online gaming, including casino-type gambling. Many such websites are known in the art, for presenting games in both a gambling and non-gambling context. Application server 101 contains code for running and operating various gambling games, as is known in the art. Web server 103 acts as an interface to the Internet 104, and provides a mechanism for presenting games to players. Players use client machines 105 to access web server 103 over the Internet 104 in a conventional manner, through Internet connections such as via an Internet Service Provider (ISP, not shown).

Application server 101 interacts with player database 102 to keep track of player information, including stored tokens, demographic data, playing history, and the like. One skilled in the art will recognize that many types of information may be stored and tracked with respect to players, both individually and in the aggregate. Application server 101 may also interact with other databases (not shown) to keep track of information regarding the operation of the gambling system as a whole, such as for example the total number of tokens that have been issued in a given time period.

Method of Operation

Figure 2:
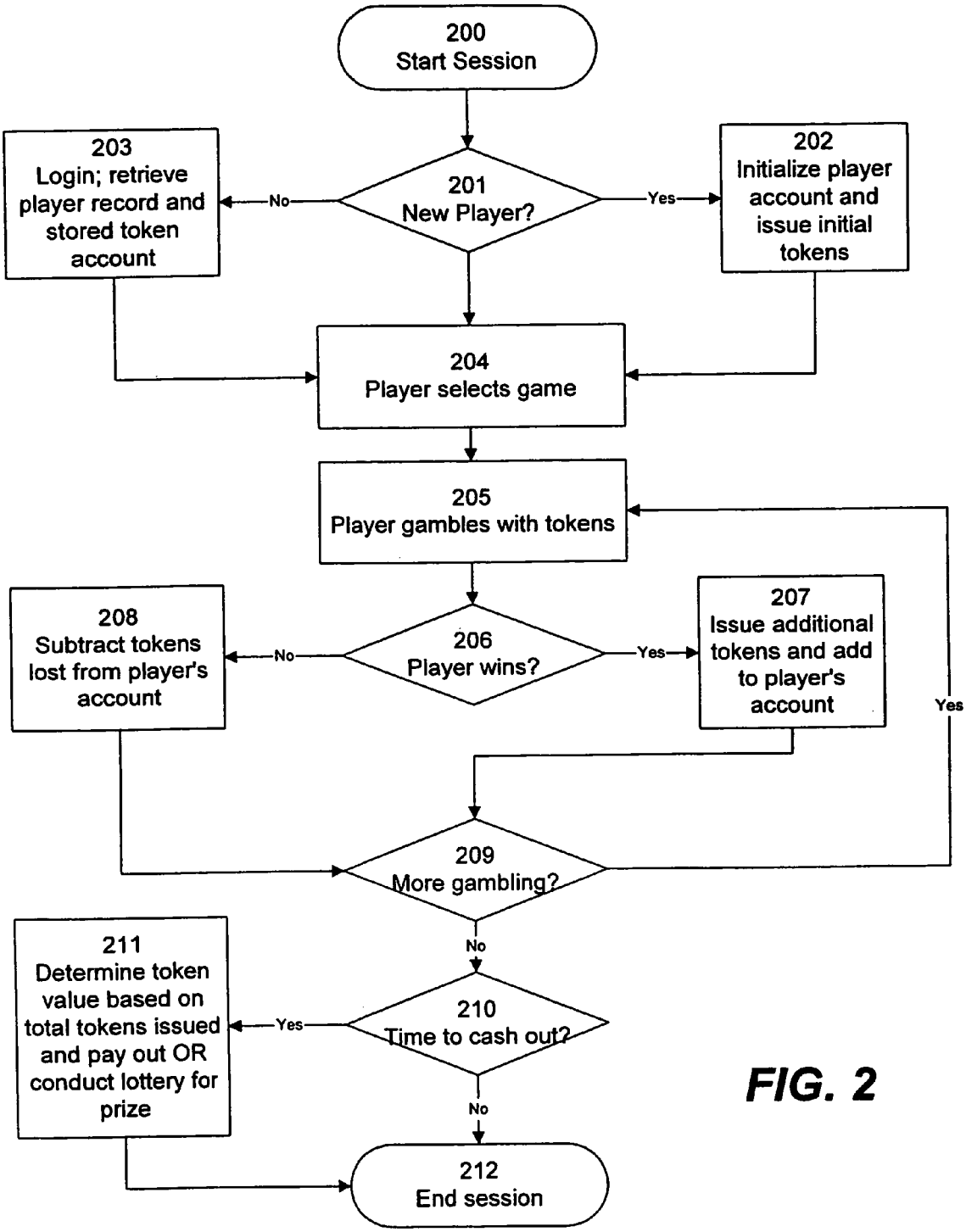
FIG. 2 is a flowchart of a method for practicing the present invention.

Referring now to FIG. 2, there is shown a flowchart of a method of operation of one embodiment of the present invention. One skilled in the art will recognize that the particular steps shown in FIG. 2 are merely exemplary of a method of operation, and that other methods and sequences of steps can be implemented without departing from the essential characteristics of the invention.

A gambling session starts 200, such as when a player accesses the gambling website over the Internet. A determination is made as to whether the player is a new player 201 (i.e. whether he or she has previously gambled at this site). Such determination may be made by asking the user to provide a login or password, or by detecting a cookie on the user's machine, or by other means as are known in the art. If the player is a new player, a player account is initialized 202 (for example, using a login identifier and password supplied by the player), and initial tokens are issued. In one embodiment, each new player is granted a fixed number of initial tokens, either for free or for a price. Tokens are, in one embodiment, virtual in nature, so that they are not represented by physical items, but rather are tracked in player database 102 associated with the online gambling system (although in alternative embodiments, tokens might be represented by physical items such as chips). The player may be presented with a display (in the form of a web page) that indicates the number of tokens in the player's account. In one embodiment, player initialization requires a fee (which can be used to subsidize winnings); in other embodiments, player initialization may be performed without charge (such as, for example, in environments that are supported by advertising).

When issuing tokens, as in step 202, the system also keeps track of the total number of tokens issued. This total number determines the value of each individual token, since the total value of all tokens remains fixed. In another embodiment, predefined time periods are established, and the token total is tracked for each individual time period. Thus, at the end of a time period, the token value is determined and a payout is made (or a lottery is conducted), as described below, based on the total number of tokens issued in that time period. In such an embodiment, the system tracks token totals, both individual and aggregate, for each particular time period.

If the player is not a new player, he or she logs in 203, and the system retrieves the player record identified by the login. The player record includes a token account indicating how many tokens the player currently has. Various degrees of persistence of tokens may be provided, so as to encourage different types of behavior. Thus, tokens may be set to expire after a predetermined length of time, or they may be automatically cashed out at particular times, as described above. Alternatively, tokens may be persistent, so that a player can keep his or her tokens as long as desired; when the player cashes out, token value is assessed and the player paid (or the tokens may be exchanged for lottery tickets). Token persistence can induce a player to continue to return to the website or casino for additional sessions. One skilled in the art will recognize that the present invention does not require any particular level of token persistence.

The player selects 204 from a number of available games. In one embodiment, the website may offer several different gambling games, such as video poker, slots, and the like. The player may select a game by clicking on a hyperlink associated with the desired game.

The player then gambles 205 using the tokens in his or her account. In one embodiment, gambling takes place by interacting with the online game in a conventional manner. In another embodiment, gambling takes place in a casino as is known in the art. The present invention encourages the player to gamble for an extended period of time by providing a net positive return; although the player will experience ups and downs in the course of the gambling session, prolonged play will be rewarded by net positive results. By encouraging players to play for a longer period of the time, the present invention adds value to advertisements that are presented to players during gameplay.

When the player wins 206, additional tokens are issued 207 and added to the player's account. When the player loses, tokens are subtracted 208 from the player's account. Tokens therefore carry some measure of actual value, and the player experiences a real sense of risk-taking (and enjoyment, hopefully) when gambling his or her tokens.

If the player continues gambling 209, the method returns to step 205. When the player finishes gambling, the method proceeds to step 210. In step 210, the method determines whether it is time to cash out the player's tokens. Cash-out may take place at predetermined times in order to convert tokens to real value and/or hold lotteries. In another embodiment, cash-out may take place upon the player's request. When it is time to cash out, token value is determined 211 by dividing the total cash to be paid out by the total number of outstanding tokens (or total number issued within the time period). Each token is assigned a value based on this determination. Each player is then credited with a cash value (or equivalent) based on the number of tokens in his account. The account is then reset to zero tokens, or to some fixed starting amount.

Alternatively, a lottery may be held using tokens as lottery tickets. A prize is paid out to the winner or winners of the lottery. The chance of winning depends on (a) the number of tokens in a player's account, and (b) the total number of tokens issued (or issued within a time period). The prize(s) to be paid out can be determined in advance, so that the operator of the website or casino can specify the amount of winnings that will be distributed in any given time period. By retaining a fixed total prize value in this manner, the present invention avoids the problems associated with providing players with a net positive return on gambling, and in particular avoids the problem of unlimited cash payout.

The session then ends 212.

Modification of Games to Provide Positive Return

As discussed above, the present invention provides players with a net positive return on their gambling, while retaining an element of risk and reward so as to maintain the entertainment value of the gambling activity. Many conventional casino games can be modified in accordance with the present invention to provide positive return. The following description provides examples of modifications that can be made to conventional online gambling games to ensure positive returns to the player over time. Such modifications include:

- Modification of payouts for specific events to provide better expected returns;
- Addition of special cards (or similar elements) associated with bonus payoffs;
- Addition of multiplier elements to existing game systems;
- Addition of "wild" elements in games;
- Creation of additional winning conditions;
- Addition of "bonus spinners" to existing games to provide enhanced payouts;
- Extending gameplay until some player wins;
- Integration of "sponsored peek" features to allow players to look ahead into decks of cards;
- Addition of bonuses for sequential wins or other non-core game conditions;
- Integration of sponsored elements into core gameplay; and
- Regular dispensing of "always win" credits.

The following subsections provide specific and detailed discussions of modifications to various gambling games. The descriptions provided below are intended to be exemplary of the types of modifications that can be effected in order to implement the present invention; the descriptions are not intended to limit the scope of the invention.

Payout Modifications

Individual payouts can be modified to provide positive return. Games that employ modifications of payouts for specific events include, for example, slot machines, Video Poker, Jokers Wild Poker, and original games such as Football Pick 'Em and Pigskin Paydirt (described below).

Slot Machines

Conventional slot machines, whether provided as real-world physical machines or virtual (software-based) machines, are pre-programmed to provide a specific rate of return on player investment. Positive return can be assured by programming payoffs accordingly. For example, the following payoffs might be provided:

| Reels shown | Payoff | Odds of Occurrence (%) | Yield per token |
|---|---|---|---|
| 3 Lamps | 2000 | 0.0135 | 0.27 |
| 3 Gems | 1000 | 0.0105 | 0.105 |
| 3 Camels | 400 | 0.064 | 0.256 |
| 3 Swords | 200 | 0.0864 | 0.1728 |
| 3 Gold | 100 | 0.0216 | 0.0216 |
| 2 Gold | 20 | 1.0584 | 0.21168 |
| 2 Camels | 10 | 2.176 | 0.2176 |
| 2 Swords | 4 | 2.6736 | 0.106944 |
| 1 Gold | 2 | 16.92 | 0.3384 |
| 3 Carpets | Story (50 tokens on average - unevenly distributed) | 1.81 | 0.905 |
| No win | 0 | 74.445995 | 0 |
| TOTAL | | | 2.605024 |

This gives the player a total expected yield of 2.605024 tokens paid per token bet, providing a strong sense of positive return over time. This design also allows the player to win some tokens slightly over 25% of the time he or she plays this game. By contrast, conventional slot machines in actual casinos typically return less than one coin per coin played, yielding a net return rate of approximately 90 to 97%.

Additional features and payouts may also be provided. For example, in one embodiment, a "wild" feature is added, as discussed below. In another embodiment, a cash jackpot, having a very low chance of occurrence, might be added to the above payouts.

Video Poker

Video Poker, as modified for implementing the present invention, operates in essentially the same manner as conventional casino video poker machines, with adjustments to the amount paid for each winning combination so as to provide positive return. For example, the following payout table could be used (for illustrative purposes, the table assumes perfect play on the part of the player for all video poker versions):

| Hand | Tokens | Frequency (in %) | Yield per token |
|---|---|---|---|
| Special Jackpot Hand | Jackpot | .00000182075 | n/a |
| Royal Flush | 2000 | 0.0026 | 0.052 |
| Straight Flush | 200 | 0.0111 | 0.0222 |
| Four of a Kind | 80 | 0.236 | 0.1888 |
| Full House | 20 | 1.1502 | 0.23004 |
| Flush | 15 | 1.105 | 0.16575 |
| Straight | 12 | 1.1279 | 0.135348 |
| Three of a Kind | 4 | 7.4344 | 0.297376 |
| Two Pair | 2 | 12.9152 | 0.258304 |
| Jacks or Better | 1 | 21.3534 | 0.213534 |
| No winner | 0 | 54.6642 | 0 |
| TOTAL | | | 1.563352 |

This gives the player a payout of 1.563352 tokens per token risked, again well in excess of the "break even" point for the player's wager. The fact that the player must risk coins every time he or she plays, but still loses that wager more than half the time, provides a clear sense of risk and suspense.

Additionally, in one embodiment, a jackpot payout is provided, and randomly distributed "jackpot eligible" cards are included.

By way of contrast, a typical payout table for conventional video poker yields anywhere from 0.94 to 0.999030 coins per coin bet. An example of the high end of this range is shown below (as posted on www.thewizardofodds.com).

| Jacks or Better | | | | |
|---|---|---|---|---|
| Hand | Payoff | Number | Probability | Return |
| Royal Flush | 940 | 523487220 | 0.000026 | 0.024686 |
| Straight Flush | 50 | 2210097684 | 0.000111 | 0.005544 |
| 4 of a Kind | 25 | 47036519220 | 0.002360 | 0.058993 |
| Full House | 9 | 229274750340 | 0.011502 | 0.103519 |
| Flush | 6 | 220266691236 | 0.011050 | 0.066301 |
| Straight | 4 | 224836698648 | 0.011279 | 0.045118 |
| 3 of a Kind | 3 | 1481912846688 | 0.074344 | 0.223032 |
| Two Pair | 2 | 2574414297144 | 0.129152 | 0.258304 |
| Jacks or Better | 1 | 4256413692336 | 0.213534 | 0.213534 |
| Nothing | 0 | 10896341436684 | 0.546642 | 0.000000 |
| Total | | 19933230517200 | 1.000000 | 0.999030 |

Jokers Wild Video Poker

Jokers Wild Video Poker (actually, a two-wild joker machine) uses a similar scheme to the above-described video poker game. The same winning hands appear with the same frequency as in a casino Jokers Wild Video Poker machine (with two jokers), but payouts for various winning hands are greatly enhanced.

The following is an example of a payout table for Jokers Wild Video Poker as modified for implementing the present invention.

| Hand | Tokens | Frequency (in %) | Yield per token |
|---|---|---|---|
| Special Jackpot Hand | Jackpot | .000001540641666 | n/a |
| Natural Royal Flush | 2000 | 0.0022 | 0.044 |
| Joker Royal Flush | 200 | 0.0348 | 0.0696 |
| Five of a Kind | 80 | 0.0415 | 0.0332 |
| Straight Flush | 50 | 0.1503 | 0.07515 |
| Four of a Kind | 20 | 1.8649 | 0.37298 |
| Full House | 15 | 1.8374 | 0.27561 |
| Flush | 10 | 1.9289 | 0.19289 |
| Straight | 5 | 3.4920 | 0.1746. |
| Three of a Kind | 2 | 17.7127 | 0.354254 |
| Two Pair | 1 | 9.2890 | 0.09289 |
| Nothing | 0 | 63.6464 | 0 |
| TOTAL | | | 1.685174 |

This gives an expected payout of 1.68 tokens per tokens wagered, significantly above the "break even" point for the house. The player's interest and tension are maintained by having over 63% of hand be losers.

By contrast, the standard payout table for Two Joker Poker (again, from www.thewizardofodds.com) is shown below. It provides a total payout of 0.981007 coins per coin wagered.

| Double Joker Poker | | | |
|---|---|---|---|
| Hand | Payoff | Probability | Return |
| Royal Flush | 800 | 0.000022 | 0.017806 |
| Wild Royal | 100 | 0.000348 | 0.034774 |
| 5 of a Kind | 50 | 0.000415 | 0.020732 |
| Straight Flush | 25 | 0.001503 | 0.037571 |
| 4 of a Kind | 8 | 0.018649 | 0.149193 |

-continued

| Double Joker Poker | | | |
|---|---|---|---|
| Hand | Payoff | Probability | Return |
| Full House | 5 | 0.018374 | 0.091868 |
| Flush | 4 | 0.019289 | 0.077157 |
| Straight | 3 | 0.034920 | 0.104761 |
| 3 of a Kind | 2 | 0.177127 | 0.354253 |
| 0.17462 Pair | 1 | 0.092890 | 0.092890 |
| Nothing | 0 | 0.636464 | 0.000000 |
| TOTAL | | | 0.981005 |

Pick 'Em

Pick 'Em uses a format similar to an office sports pool, in which the player picks the winners of all games to be played in a given time period (such as a weekend of NFL football, for example). The player simply picks who will win these games; no picking against the point spread is necessary. In order to stimulate the player's sense of risk and suspense, players must pay 100 tokens to play the game each week. The site operator then pays the player twenty tokens per game that he or she picks correctly, in addition to bonuses for picking eight or fewer games incorrectly. For a typical application to an NFL schedule, with each weekly NFL schedule including 14.6 games, players will on average pick more than seven games correctly (assuming strictly random choices and outcomes).

Here is the payout table for Pick 'Em for an NFL week containing 15 games, showing the tokens returned against the player's 100 token stake. Probabilities shown assume random picks and outcomes.

| Correct Picks | Probability (in %) | Per Pick Tokens | Bonus Tokens | Yield per 100 tokens |
|---|---|---|---|---|
| 0 | 0.0030517578125 | 0 | 0 | 0 |
| 1 | 0.0457763671875 | 20 | 0 | 0.0091552734375 |
| 2 | 0.3204345703125 | 40 | 0 | 0.128173828125 |
| 3 | 1.3885498046875 | 60 | 0 | 0.8331298828125 |
| 4 | 4.1656494140625 | 80 | 0 | 3.33251953125 |
| 5 | 9.1644287109375 | 100 | 0 | 9.1644287109375 |
| 6 | 15.2740478515625 | 120 | 0 | 18.328857421875 |
| 7 | 19.6380615234375 | 140 | 100 | 47.13134765625 |
| 8 | 19.6380615234375 | 160 | 100 | 51.0589599609375 |
| 9 | 15.2740478515625 | 180 | 250 | 65.67840576171875 |
| 10 | 9.1644287109375 | 200 | 250 | 41.23992919921875 |
| 11 | 4.1656494140625 | 220 | 500 | 29.99267578125 |
| 12 | 1.3885498046875 | 240 | 1,000 | 17.218017578125 |
| 13 | 0.3204345703125 | 260 | 2,500 | 8.843994140625 |
| 14 | 0.0457763671875 | 280 | 5,000 | 2.4169921875 |
| 15 | 0.0030517578125 | 300 | 25,000 | 0.7720947265625 |
| TOTAL | | | | 296.14868164063 |

This puts the expected return on a 100-token bet at 296.1486, a very high rate. Note that the mode and median values of 250 tokens paid are also quite strong. The values for a 14-game week are even higher.

By contrast, this type of game in an office pool setting typically yields extremely high odds of losing, as generally only the top one or two players in such games receive any return on their investment. A similar game in a casino setting would likely force the player to pick well over half the games right to realize a positive return on his or her investment.

Sports Book

The present invention can also be applied to sports books, such as those allowing a player to wager on the outcomes of sporting events. Modifications to sports book gambling to operate in connection with the present invention allows players to experience positive returns while wagering their prize tokens against the point spreads of sporting events such as football games. For example, payout can be structured so as to double the player's bet if he or she picks the game correctly, keep the player's entire bet if they pick incorrectly, and return the player's bet to him or her if the game's point differential exactly matches the point spread. Another payout structure would pay the player 225–250% if he or she picks the game correctly and/or paying all bettors as winners on games where the point spread is covered exactly.

Keno

Keno is a well-known game that may be modified to provide positive return by adjusting payouts. The game could also be modified to be more favorable with any set of pay tables (including the current set) by deleting some of the available numbers (say to a 70-number board) or by drawing more numbers (say 25) that could potentially match up with the numbers chosen by the players. One skilled in the art will recognize that other types of modifications are also possible.

Bingo

Bingo can be modified to require a buy-in (in tokens) and to pay the player a certain number of tokens per space covered, along with offering a large bonus for making the bingo pattern.

Solitaire

Solitaire, another well-known game, could be modified to charge the player a fixed amount of tokens at the start of each game, and then pay him or her for each card he or she is able to play onto the foundation (victory or tableau) stacks. The costs and payoffs in this game may be delicately balanced to ensure that players average approximately 1.5 times as many tokens in rewards as they pay to play the game. One example of such a structure would be to require the player to pay twenty tokens for a game and to receive two tokens for each card he or she plays on to the foundation stacks.

Special Bonus Cards

Another mechanism for modifying games to provide positive return in card-based gambling games is to provide bonus cards that occasionally replace standard cards when those cards are dealt from the deck. The addition of these cards to the game changes the odds in games such as blackjack, for example, to provide a positive return.

The player is paid a significant number of bonus tokens (ranging from 100 to 5000 tokens) if he or she wins a hand while holding a bonus card. For a blackjack game with an average deck lasting about nine games, assuming that a player bets fifty tokens per hand (the maximum allowable on each hand), and loses 0.5% of all bets (using the advice of a tip button), he or she would normally lose about 2.25 tokens each time he or she plays through the deck. Inclusion of bonus cards tips the odds significantly in the player's favor.

The following is an example of a bonus card structure, showing the likelihood that each special card will appear along with its bonus payout.

| Card Name | Frequency (in %) | Payoff | Contribution |
|---|---|---|---|
| Gold Ace of Clubs | 0.0125 | 5000 | 0.1094 |
| Gold Ace of Diamonds | 0.0125 | 3000 | 0.0656 |
| Gold Ace of Hearts | 0.0125 | 2000 | 0.0468 |
| Gold Ace of Spades | 0.0125 | 1000 | 0.0219 |
| Gold Jack of Clubs | 0.4444 | 2500 | 1.9444 |
| Gold Jack of Diamonds | 0.5 | 2000 | 1.75 |
| Gold Jack of Hearts | 0.5714 | 1000 | 1.0 |
| Gold Jack of Spades | 0.6667 | 500 | 0.5833 |
| Silver Jack of Clubs | 10.6667 | 500 | 9.333 |
| Silver Jack of Diamonds | 16.1667 | 250 | 7.0729 |
| Silver Jack of Hearts | 32.7619 | 150 | 8.6 |
| Silver Jack of Spades | 99.3333 | 100 | 17.3833 |
| TOTAL | | | 47.9106 |

Contributions are reduced to payout probability or 17.5% to account for the fact that the dealer will receive the special card 50% of the time (making the player ineligible for the bonus), and that the player will lose or push approximately 65% of hands (again, making the player ineligible).

All told, these cards give the player an expected return of 47.9106 tokens per deck, more than offsetting any expected losses. For a player betting maximum stakes, this would be slightly more than 10% of tokens wagered. For players betting two tokens per game, this amounts more than 200% of their total stakes.

A similar practice can be employed in video poker games to regulate the awarding of jackpots. Each time a card that can be part of a royal flush in spades appears, there is a 70% chance that it is a "jackpot eligible" card. When a player makes a sequential royal flush from such cards, he or she wins the jackpot.

Other card games could similarly be extended through the use of bonus cards as described above, bringing significant token bonuses if the bonus cards are part of a winning hand.

In addition, such an approach may be applied to Bingo- or Keno-type games, where announced numbers could have a random chance of being bonus balls or chips. When a player who uses one or more of these numbers wins the game, he or she can collect token bonuses as well.

Addition of Multiplier Elements

Games such as roulette can be modified in accordance with the present invention by providing multiplier spaces. Such spaces deliver multipliers (such as 2, 3, 5, or 10) to any winning bets on the next number spun at preset probabilities.

Multiplier elements can be applied to many casino games. For example, video poker and slots pay tables can be extended to include a "multiplier" combination that enhances the payouts on the following hand/spin. For instance, a player who pulls a low pair in video poker (say any number from two to six) could have the winnings on his or her next hand multiplied by that number.

In slot machine games, multiplier spins would augment existing payouts with one or more reel combinations. If one of the multiplier reel combinations appears, then the multiplier value (from 2×–10×) could appear in an area on the screen. If the player then spins a winning combination, his or her token winnings are multiplied by the appropriate amount. Consecutive hits on multiplier spots add the multipliers.

Similarly, a multiplier ball or chip can be added Keno and Bingo games. This number ball or chip is an additional element added to the pool of numbers to be pulled, and may have a fixed percentage chance of being pulled each time a number is drawn (or may be just one more chip or ball in the pool, with normal probabilities). If this chip or ball is pulled during the course of a game, then any player who wins that game receives double the normal winnings.

Addition of Wild Elements

Wild elements can be added to many gambling games to enhance the player's positive return on investment. These elements allow the player to claim success whenever this element enters the game, and go well beyond the traditional use of wild cards in card games.

For example, a wild symbol can be added to slot machines, in such a manner that the wild symbol appears a small percentage of the time. When this symbol appears, it is evaluated in combination with the other symbols on that spin as the most favorable possible symbol for the player, making the highest-paying combination possible. As an alternative to adding a new symbol, the current jackpot symbol can be treated as a wild symbol.

Roulette can also be modified to include a wild element. Wild spots on the roulette wheel add one or more spots to the roulette wheel that cause all bets to be paid whenever the ball lands there. Adding this space without altering the existing payouts improves the payoff on all bets, ranging from eliminating the house edge on even money bets to tilting single number bets heavily in the player's favor (paying off bets at 35-to-1 on an event that occurs one out of 19 spins—exempting multipliers).

Similarly, one or more wild balls may be added to a Keno game in order to generate positive returns. These wild balls are mixed in with the number of balls selected by the game to determine the winning numbers, and each wild ball drawn counts as one of the 20 winning numbers selected for that round. The wild ball counts as a correct pick by the player regardless of what numbers the player picked, augmenting his or her number of "natural" correct picks by one.

Creating Additional Winning Conditions

Gambling games can be tilted further in the player's favor by creating additional winning conditions. For example, in roulette a second ball may be introduced. Two balls are launched at the same time, yielding two different winning numbers 77.6% of the time and significantly raising the likelihood that any given bet will win. This also produces multiplied wins 20.9% of the time, creating larger winnings for those players that did pick the single number.

Integrating Bonus Spinners

Another element that may be introduced in order to provide positive returns is to allow the player to spin a bonus spinner element, which awards a large token bonus or a cash jackpot whenever a player exceeds a challenging gameplay threshold (such as making a total of 21 nine times while dealing from a deck of cards). In another example, solitaire can be modified to allow the player an opportunity to spin a bonus spinner that could potentially double his or her winnings after the click on a sponsor's banner ad. Similar elements may be added to many other casino games once a specific performance threshold is established (for instance consecutive wins in video poker, advancing to certain story elements in slot machines, and the like).

Extending Gameplay Until Some Player Wins

Another approach for establishing positive return is to continue gameplay until a player wins. For example, conventional Bingo operates in a manner that continues drawing and announcing numbers until some player in the current room claims Bingo. Not only does this ensure that some player will win, but by extending game length gives all other players a better chance of winning. A similar approach can be applied to games such as Keno and roulette. In Keno, instead of always drawing exactly 20 numbers, the modified game draws 20 numbers, and then continues drawing and announcing numbers until at least one player in the room (which may be a "virtual room") has completed at least 80% of his or her numbers. Similarly, all numbers spun in roulette as modified are disregarded until the wheel generates a number that at least one player at the table (or in the room) had bet on.

Integration of Sponsored Peeks Into Card Games

In card-based games such as video poker, blackjack, and solitaire game, positive return can be established by adding "sponsored peek" elements. A sponsor's banner advertisement is placed on the web page associated with the game; the player may click on the banner at any time in order to view the next card in the deck. This modification allows the player to dramatically improve his or her chances of winning while providing additional advertising revenue. This modification can easily be applied to any single-player card game.

Addition of Bonuses for Sequential Wins or Other Non-Core Game Elements

In one embodiment of the present invention, consecutive wins by a player trigger a token bonus. Where such a bonus is sufficiently large, positive return can be attained, and prolonged play is thus encouraged.

Regular Dispensing of "Always Win" Credits

Another technique for providing positive return involves dispensing "always win" credits. These credits are dispensed, for example, as a reward for continuous play in a single session. In a slot machine game, for example, every 100 games, a player receives a "Magic Coin" in the form of an on-screen icon. When the player clicks this coin, he or she is entitled to a free spin of reels as though he or she had played at maximum stakes (even though the player is not charged any tokens), and he or she is guaranteed that the next spin will be a winner.

Similarly, every 50 games of roulette, the player receives a "guaranteed" chip. This chip does not cost the player anything, but functions as a 25-token marker that remains on the table until it wins or until the player quits the game.

Such elements are unique in that they are provided on a regular basis and thus encourage prolonged play. As long as players are willing to stay for a sufficient number of games in a single sitting, they are guaranteed to receive these incentives that guarantee wins.

From the above description, it will be apparent that the invention disclosed herein provides a novel and advantageous system and method of enabling positive-return gambling. The foregoing discussion discloses and describes merely exemplary methods and embodiments of the present invention. In particular, the above-described embodiments present the invention in the context of a website for providing online gambling games. As will be understood by those familiar with the art, the invention may be embodied in other specific forms without departing from the spirit or essential characteristics thereof. For example, the techniques of the present invention could be applied to games in real-world casinos, or in other environments. Accordingly, the disclosure of the present invention is intended to be illustrative, but not limiting, of the scope of the invention, which is set forth in the following claims.

What is claimed is:

1. A game system, comprising:

a game apparatus configured to provide a game and to credit and debit a token account associated with a first user responsive to gameplay of the first user in the game, wherein tokens are credited to the token account after payout events associated with the game, each payout event having an associated payout value of zero or more tokens and an odds of occurrence, wherein for each payout event, the payout value multiplied by the odds of occurrence produces a yield per token bet, wherein a total of the yields per token bet for all payout events is greater than one, and wherein said payout events having a non-zero yield per token bet have a combined odds of occurrence of less than 50 percent; and a token conversion module for converting tokens in the token account according to a token value determined based on a total number of tokens in a set of tokens.

2. The system of claim 1, wherein the total number of tokens varies, and wherein a total value of all tokens in the set of tokens is constant.

3. The system of claim 1, wherein the token conversion module comprises a module for randomly selecting at least one token from the set of tokens, and awarding at least one predefined prize to a player whose account contains the selected token.

4. The system of claim 1, wherein the token conversion module determines a cash value for each token by dividing a predetermined cash award by the number of tokens in the set of tokens.

5. The system of claim 4, further comprising a payout module, coupled to the token conversion module, for paying at least a subset of the players the cash value of at least a subset of the tokens in the player's token account.

6. The system of claim 1, wherein the set of tokens comprises all tokens awarded within a defined time period.

7. The system of claim 1, wherein the token conversion module automatically converts tokens at the expiry of a predetermined time period.

8. The system of claim 1, wherein the game is selected from the group consisting of:

video poker;
slot machine;
blackjack;
roulette;
sports pool;
sports book;
keno;
bingo; and
solitaire.

9. The system of claim 1, wherein the game apparatus comprises a network-enabled user interface for accepting input and providing output over a network.

10. The system of claim 9, wherein the network comprises the Internet.

11. The system of claim 1, wherein the game apparatus comprises an automated game machine.

12. A method of providing a game, comprising:

providing an initial quantity of tokens to a player;

crediting and debiting a token account of the player responsive to gameplay of the player in a game, wherein tokens are credited to the token account after payout events associated with the game, each payout event having an associated payout value of zero or more tokens and an odds of occurrence, wherein for each payout event, the payout value multiplied by the odds of occurrence produces a yield per token bet, wherein a total of the yields per token bet for all payout events is greater than one, and wherein said payout events having a non-zero yield per token bet have a combined odds of occurrence of less than 50 percent; and converting tokens according to a token value determined based on a total number of tokens in a set of tokens.

13. The method of claim 12, wherein the total number of tokens in the set varies, and wherein a total value of all tokens in the set of tokens is constant.

14. The method of claim 12, wherein converting tokens comprises randomly selecting at least one token from the set of tokens, and awarding at least one predefined prize to a player having the selected token.

15. The method of claim 12, wherein the game is implemented using a network-enabled user interface for accepting input and providing output across a network.

16. The method of claim 12, wherein the game is implemented on an automated game machine.

17. A computer-readable medium including code for controlling a processor to provide a game, the code including instructions to:

provide an initial quantity of tokens to a player;

credit and debit a token account of the player responsive to gameplay of the player in a game, wherein tokens are credited to the token account after payout events associated with the game, each payout event having an associated payout value of zero or more tokens and an odds of occurrence, wherein for each payout event, the payout value multiplied by the odds of occurrence produces a yield per token bet, wherein a total of the yields per token bet for all payout events is greater than one, and wherein said payout events having a non-zero yield per token bet have a combined odds of occurrence of less than 50 percent; and convert tokens according to a token value determined based on a total number of tokens in a set of tokens.

18. The computer-readable medium of claim 17, wherein the total number of tokens in the set varies, and wherein a total value of all tokens in the set of tokens is constant.

19. The computer-readable medium of claim 17, wherein the instructions to convert tokens comprises instructions to randomly select at least one token from the set of tokens, and award at least one predefined prize to a player having the selected token.

20. The computer-readable medium of claim 17, wherein the game is implemented using a network-enabled user interface for accepting input and providing output over a network.

* * * * *